US008851058B2

(12) United States Patent
Hoang et al.

(10) Patent No.: US 8,851,058 B2
(45) Date of Patent: Oct. 7, 2014

(54) SLOT WEAR INDICATOR FOR A GRINDING TOOL

(75) Inventors: Marc Linh Hoang, Thionville (FR); Rodolphe Martin, Howald (LU)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 0 days.

(21) Appl. No.: 13/996,928

(22) PCT Filed: Dec. 16, 2010

(86) PCT No.: PCT/US2010/060791

§ 371 (c)(1), (2), (4) Date: Oct. 10, 2013

(87) PCT Pub. No.: WO2011/029106

PCT Pub. Date: Mar. 10, 2011

(65) Prior Publication Data

US 2014/0030970 A1 Jan. 30, 2014

(51) Int. Cl.

| | |
|---|---|
| ***B24D 5/06*** | (2006.01) |
| ***B28D 1/12*** | (2006.01) |
| ***B24D 99/00*** | (2010.01) |
| ***B24D 5/12*** | (2006.01) |

(52) U.S. Cl.

CPC *B24D 5/06* (2013.01); *B28D 1/121* (2013.01); *B24D 99/005* (2013.01); *B24D 5/123* (2013.01)

USPC ..... 125/15; 51/293; 451/542

(58) Field of Classification Search

CPC ..... B24B 37/205; B24D 11/001; B24D 5/06; B24D 99/005

USPC ..... 451/541, 542, 543, 548, 550, 544; 51/293, 307, 309; 125/15, 13.01, 20

See application file for complete search history.

(56) References Cited

U.S. PATENT DOCUMENTS

| | | | | |
|---|---|---|---|---|
| 3,955,324 | A | 5/1976 | Lindstrom | |
| 6,250,295 | B1 * | 6/2001 | Chanton et al. | 125/15 |
| 7,442,113 | B2 | 10/2008 | Berman et al. | |
| 7,444,914 | B2 | 11/2008 | Brach | |
| 8,534,391 | B2 * | 9/2013 | Wirth | 175/426 |
| 2004/0214511 | A1 | 10/2004 | Bermann et al. | |
| 2006/0030245 | A1 | 2/2006 | Masuko | |
| 2006/0185492 | A1 | 8/2006 | Chianese | |
| 2006/0266176 | A1 | 11/2006 | Brach | |

FOREIGN PATENT DOCUMENTS

| | | | |
|---|---|---|---|
| EP | 1201386 | A2 | 5/2002 |
| JP | S36-000750 | B | 2/1961 |
| JP | H02063964 | U | 5/1990 |
| JP | H03277474 | A | 12/1991 |

(Continued)

OTHER PUBLICATIONS

PCT/US2010/060791, International Search Report mailed Sep. 27, 2011, 1 page.

*Primary Examiner* — Robert Rose

(74) *Attorney, Agent, or Firm* — Abel Law Group, LLP; Joseph P. Sullivan

(57) ABSTRACT

Wear indicators for abrasive articles are presented. Specifically, indicator marks that are parallel to a bonding edge of a grinding element are presented. Tools comprising a carrier element and one or more grinding elements comprising one or more indicators are also presented.

20 Claims, 7 Drawing Sheets

(56) References Cited

FOREIGN PATENT DOCUMENTS

| | | | |
|---|---|---|---|
| JP | 3049921 | U | 6/1998 |
| JP | H11239976 | A | 9/1999 |
| JP | 2000288947 | A | 10/2000 |
| KR | 20100074346 | A | 7/2010 |
| WO | 03049903 | A | 6/2003 |
| WO | 2009094377 | A1 | 7/2009 |
| WO | 2010016959 | A2 | 2/2010 |

* cited by examiner

SLOT WEAR INDICATOR FOR A GRINDING TOOL

CROSS-REFERENCE TO RELATED APPLICATION(S)

This application claims priority from PCT Application No. PCT/US2010/060791 entitled "A Slot Wear Indicator For A Grinding Tool," by Marc Linh Hoang et al., filed Dec. 16, 2010, which is assigned to the current assignee hereof and incorporated herein by reference in its entirety.

FIELD OF THE INVENTION

The invention relates to grinding tools, and more particularly to grinding tools whose grinding elements comprise one or more indicator marks designed to indicate to a user to the amount of grinding element remaining.

BACKGROUND

Conventional circular saw blades typically include a grinding element bonded to a carrier element, such as a plate or wheel. Over a period of use, the grinding elements wear down and must be replaced.

Often, it can be difficult for a user to easily determine how much of the grinding element remains. Known methods require a user to measure the remaining grinding element with a rule or a caliper and calculate the remaining life in the grinding element using that measurement and the material properties of the workpiece. These measurements take time and are rarely performed under ideal conditions. Rather, the grinding elements are measured in the field by workers who may be untrained in using a caliper and who are often in a hurry to finish the job.

Miscalculation can be costly: if the user underestimates the amount of the remaining grinding element, the circular saw blade is replaced before the end of its life, wasting a portion of the grinding element. If the user overestimates the amount of the remaining grinding element, the user risks damaging the workpiece, the carrier element, or both.

Examples of solutions known in the art include U.S. Pat. No. 6,250,295 and European Patent Application EP 1,201,386A2. Drawbacks of these known solutions are that the wear indicators may weaken the grinding element and/or that the wear indicators may become clogged with swarf or other debris during operation. As such, improved wear indicators are desired.

SUMMARY

The invention relates to grinding tools, and more particularly to grinding tools whose grinding elements comprise one or more indicator marks designed to indicate to a user to the amount of grinding element remaining.

In various embodiments, the tool body may be a thin-wheel disc, a hollow cylinder (such as for a boring tool), cup-shaped (such as for a grinding cup), or any other suitable shape. In various embodiments, a tool is presented comprising: a carrier element comprising an outer circumferential edge; and a grinding element comprising abrasive particles embedded in a metal matrix having a network of interconnected pores; a first face; a second face; a grinding edge between the first face and the second face, where the grinding edge wears in use; a bonding edge between the first face and the second face and opposite the grinding edge, where the bonding edge of each grinding element is bonded to the outer circumferential edge of the carrier element; a height equal to the distance between the grinding edge and the bonding edge; and a first indicator mark disposed on the first face of the grinding element at a first distance from the bonding edge and parallel to the outer circumferential edge of the carrier element.

In certain embodiments, the first distance is equal to one-half the height of the grinding element. The first indicator mark may comprise a contrasting color in certain embodiments.

In still other embodiments, the grinding element further comprises a second indicator mark disposed on the first face of the grinding element at a second distance from the bonding edge and parallel to the outer circumferential edge of the carrier element. In some such embodiments, the first distance is equal to two-thirds the height of the grinding element, and the second distance is equal to one-third the height of the grinding element. The first indicator mark may comprise a first color and the second indicator mark may comprise a second color.

The first indicator mark may be a groove in some embodiments, or the first indicator mark may be a ridge.

The carrier element may be disc-shaped. Embodiments of the tool may further comprise a plurality of grinding elements. Certain embodiments may further comprise a plurality of gullets disposed between the plurality of grinding elements. In some embodiments, the carrier element further comprises an arbor hole configured to receive a spindle.

In still other embodiments, where the carrier element is cylindrical. Certain embodiments further comprise a plurality of grinding elements. A connector configured to be coupled to a chuck may be present as well.

Other embodiments of a tool are presented, comprising: a carrier element comprising an outer circumferential edge; and a plurality of grinding elements, each grinding element comprising: abrasive particles embedded in a metal matrix having a network of interconnected pores; a first face; a second face; a grinding edge between the first face and the second face, where the grinding edge wears in use; a bonding edge between the first face and the second face and opposite the grinding edge, where the bonding edge of each grinding element is bonded to the outer circumferential edge of the carrier element; a height H equal to the distance between the grinding edge and the bonding edge; and N indicator marks disposed on a face of the grinding element parallel to the outer circumferential edge of the carrier element; where the N indicator marks divide each grinding element into (N+1) segments.

Indicator marks are disposed on the first face of the grinding element, the second face of the grinding element, or both. In certain embodiments, indicator marks are disposed on alternating faces of adjacent grinding elements.

In some embodiments, each segment has a segment height. Further, in additional embodiments, each indicator mark has a mark height h, and the segment height of each segment is equal to $(H-(N\times h))/(N+1)$. In various embodiments, N may be 1, 2, 3, 4, 5, or any other whole number. Indicator marks may be grooves or ridges in various embodiments.

Still other embodiments of a tool element are presented, comprising: a carrier element; and a grinding element coupled to the carrier element, the grinding element comprising: abrasive particles embedded in a metal matrix having a network of interconnected pores; a first face; a second face; a grinding portion between the first face and the second face, where the grinding portion wears in use; a bonding portion between the first face and the second face and opposite the grinding edge, where the bonding portion of each grinding element is bonded to the carrier element; a height equal to the distance between the grinding portion and the bonding portion; and a first indicator mark disposed on the first face of the grinding element at a first distance from the bonding portion and parallel to the bonding portion.

In some embodiments, the first distance is equal to one-half the height of the grinding element. The first indicator mark may comprise a contrasting color. In further embodiments, the grinding element comprises a second indicator mark disposed on the first face of the grinding element at a second distance from the bonding edge and parallel to the outer circumferential edge of the carrier element.

In some embodiments, the first distance is equal to two-thirds the height of the grinding element, and the second distance is equal to one-third the height of the grinding element. The first indicator mark may comprises a first color and the second indicator mark comprises a second color. In certain embodiments, the first indicator mark may be a groove or a ridge.

In certain embodiments, a grinding element configured to be coupled to a carrier element is presented, comprising: abrasive particles embedded in a metal matrix having a network of interconnected pores; a first face; a second face; a grinding portion between the first face and the second face, where the grinding portion wears in use; a bonding portion between the first face and the second face and opposite the grinding portion, where the bonding portion of each grinding element is configured to be bonded to the carrier element; a height equal to the distance between the grinding portion and the bonding portion; and a first indicator mark disposed on the first face of the grinding element at a first distance from the bonding portion and parallel to the bonding portion.

In certain embodiments, the first distance is equal to one-half the height of the grinding element. In other embodiments, the first indicator mark comprises a contrasting color. In still other embodiments, the grinding element further comprises a second indicator mark disposed on the first face of the grinding element at a second distance from the bonding edge and parallel to the outer circumferential edge of the carrier element. In other embodiments, the first distance is equal to two-thirds the height of the grinding element, and the second distance is equal to one-third the height of the grinding element. The first indicator mark may comprise a first color and the second indicator mark may comprise a second color. The indicator mark may be a groove or a ridge.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The embodiments of the present exercise and accessory bars, and their components, shown in the figures are drawn to scale.

DESCRIPTION OF ILLUSTRATIVE EMBODIMENTS

Figure 1:
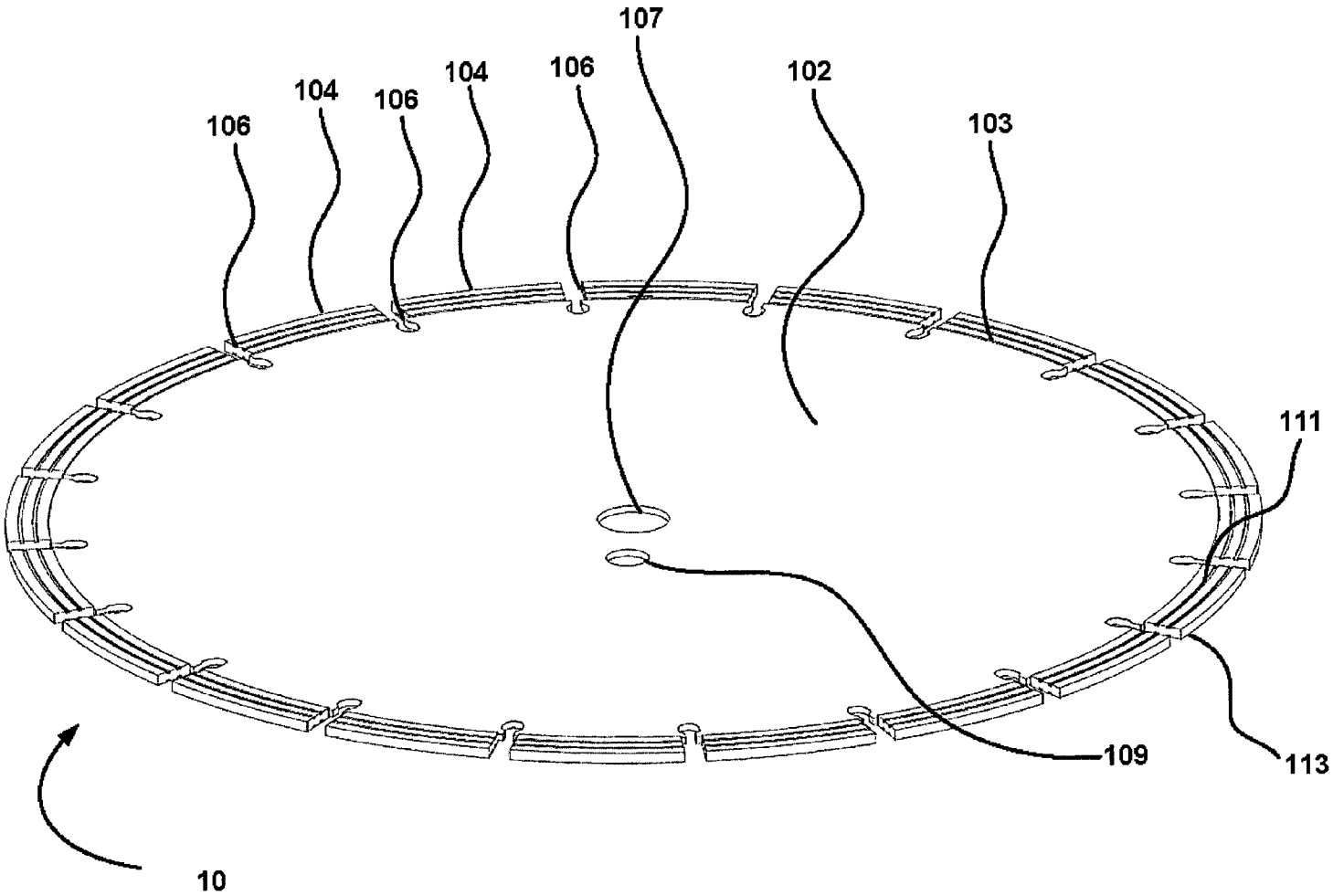
FIG. 1 illustrates a perspective view of an embodiment of a tool comprising indicator marks.

The term "coupled" is defined as connected, although not necessarily directly, and not necessarily mechanically; two items that are "coupled" may be integral with each other. The terms "a" and "an" are defined as one or more unless this disclosure explicitly requires otherwise. The terms "substantially" and "about" are defined as largely but not necessarily wholly what is specified, as understood by a person of ordinary skill in the art. In any embodiment of the present devices, the term "substantially" and the term "about" may be substituted with "within [a percentage] of" what is specified, where the percentage includes 1, 5, 10, and/or 15 percent.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, an exercise bar that "comprises," "has," "includes" or "contains" one or more elements possesses those one or more elements, but is not limited to possessing only those elements.

Further, a device or structure that is configured in a certain way is configured in at least that way, but it can also be configured in other ways than those specifically described.

Conventional grinding tools (such as saw blades) typically include one or more grinding elements bonded to a central carrier element that is configured to be coupled to a spindle of a machine. The one or more grinding elements often comprise an abrasive suspended in a metal matrix, and wear down with use.

The grinding tool must be replaced before the grinding elements wear off completely; otherwise, contact between the carrier element and the word piece can damage the work piece and/or injure the user. In typical circumstances, users of conventional grinding tools must measure (e.g. with calipers or a ruler) the remaining height of the grinding elements to calculate the life left in the grinding tool.

Field conditions can make such measurement difficult. Users of grinding equipment may be untrained in the use of calipers and thus make an inaccurate measurement.

Turning now to the figures, FIGS. 1-6D illustrate embodiments of a tool 10. Tool 10 may be a saw blade, a grinder, or a cutting-off tool, for example. Tool 10 comprises a disk-shaped carrier element 102 and at least one grinding element 104 coupled to the carrier element 102.

In the illustrated embodiment, carrier element 102 is substantially circular (or disc-shaped) in shape. Carrier element 102 comprises an outer circumferential edge 103. In the illustrated embodiment, outer circumferential edge 103 is intersected by a plurality of gullets 106. In one example embodiment, carrier element 102 includes two discrete outer layers that are mechanically fastened directly to one another (e.g., via welds, rivets, and/or nut-and-bolt arrangement). Alternatively, carrier element 102 may be a sandwich-type core, where two discrete outer layers sandwich an inner layer of noise-damping material such as cork, glue, epoxy or other suitable damping material (e.g., resin, copper, and soft iron). Alternatively, carrier element 102 may be integrally formed through a suitable metrology or molding process (e.g., metal casting, injection molding, hot-pressing, cold-pressing, etc). The outer layers of carrier element 102, whether they are discrete or integral in nature, may be fabricated from substantially any material having sufficient strength for the cutting application or applications at hand. Examples of suitable materials include steel, aluminum, titanium, bronze, their composites and alloys, and combinations thereof (e.g., ANSI 4130 steel and aluminum alloys, 2024, 6065 and 7178). Alternatively, for some applications, reinforced plastics or non-metallic composites may be used to construct carrier element 102.

Carrier element 102 comprises an arbor hole 107 for mounting on and fastening to the spindle of a circular saw or other suitable machine as conventionally done (e.g., with a threaded fastener). In some embodiments, carrier element comprises a drive pin-hole 109. In some embodiments, tool 10 may further include a bushing such as described in U.S. Patent Application Publication No. 2006/0185492, and/or an assembly for accommodating multiple bore sizes such as described in U.S. Patent Application Publication No. 2006/0266176. Each of these patent applications is herein incorporated by reference in its entirety. For example, tool 10 configured in accordance with embodiments of the present invention can be used in any number of applications. For instance, tool 10 can be installed on a gasoline powered handheld saw (e.g., STIHL TS760, manufactured by Andreas Stihl AG), and used to dry cut a steel plate. Likewise, tool 10 can be installed onto a floor saw (e.g., Clipper CSB1 P 13, manufactured by Saint-Gobain SA), and used to wet cut concrete. Likewise, tool 10 can be installed onto an automatic, 14 HP (10.3 kW) cut-off sawing machine (e.g., HUARD 30V53, manufactured by HUARD), and used to cut a steel or plastic tube. Numerous suitable machines and applications will be apparent in light of this disclosure.

In the embodiments shown in FIGS. 1-5D, tool 10 comprises a plurality of grinding elements 104 that are bonded to outer circumferential edge 103 of carrier element 102. Each grinding element 104 comprises a first face 111 and a second face 113.

Grinding elements 104 are separated from one another by gullets 106 in the illustrated embodiments. Gullets 106 are formed in the carrier element 102 between each grinding element 104 to balance and quiet the tool 10. Gullets 106 may further assist in removing swarf from the workpiece. Gullets 106 may be ellipsoidal, d-shaped, b-shaped, music-note-shaped, overlapping, or of any other suitable shape or configuration. Further configurations for gullets 106 are discussed in International Application No.: PCT/US2009/031544, which is fully incorporated by reference herein.

Other embodiments of tool 10 comprise a single continuous grinding element 104 that is bonded to outer circumferential edge 103. Gullets 106 may not be present in such embodiments.

Grinding elements 104 comprise abrasive particles embedded in a metal matrix. In exemplary embodiments, grinding elements 104 are formed by casting a molten mixture of the abrasive particles and the metal matrix in a mold. The metal matrix can have a network of interconnected pores or pores that are partially or substantially fully filled with an infiltrant. A bonding region can be between the carrier element 102 and the grinding element 104 and can contain a bonding metal. The bonding metal in the bonding region can be continuous with the infiltrant filling the network of interconnected pores.

One example of a grinding element 104 includes abrasive particles embedded in a metal matrix having a network of interconnected pores. The abrasive particles may be a superabrasive such as diamond or cubic boron nitride. The abrasive particles may have a particle size of not less than about 400 US mesh. In specific embodiments, abrasive particles have a particle size of not less than about 100 US mesh. In other embodiments, abrasive particles have a particle size of between about 25 US mesh and about 80 US mesh. Depending on the application, the size can be between about 30 and 60 US mesh. The abrasive particles can be present in an amount between about 2% by volume to about 50% by volume. In specific embodiments, grinding element 104 includes between about 2% by volume and about 6.25% by volume abrasive particles.

The metal matrix can include iron, iron alloy, tungsten, cobalt, nickel, chromium, titanium, silver, and any combination thereof. In an example, the metal matrix can include a rare earth element such as cerium, lanthanum, and neodymium. In another example, the metal matrix can include a wear resistant component such as tungsten carbide. The metal matrix can include particles of individual components or pre-alloyed particles. The particles can be between about 1.0 microns and about 250 microns.

In an exemplary embodiment, the bonding metal composition can include copper, a copper-tin bronze, a copper-tin-zinc alloy, or any combination thereof. The copper-tin bronze may include a tin content not greater than about 20% by weight, such as not greater than about 15% by weight. Similarly, the copper-tin-zinc alloy may include a tin content not greater than about 20% by weight, such as not greater than about 15% by weight, and a zinc content not greater than about 10% by weight. Further configurations for grinding elements 104 are discussed in International Application No. PCT/US2009/043356, which is fully incorporated by reference herein.

Figure 2:
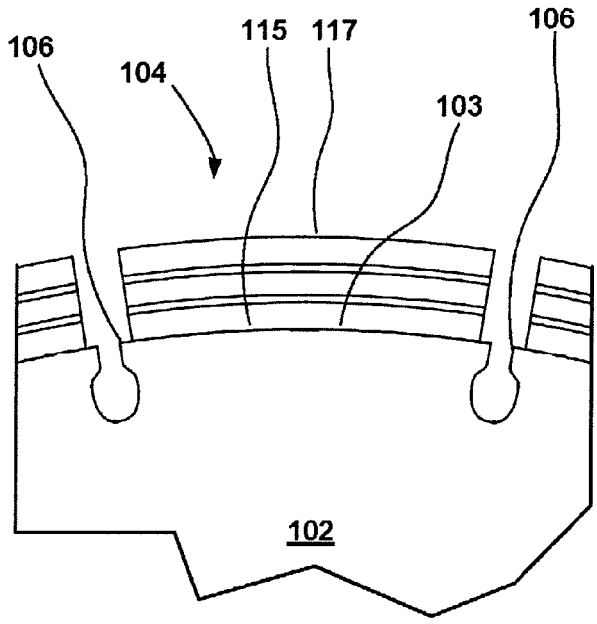
FIG. 2 illustrates a detail view of an embodiment of a tool comprising indicator marks.

As shown in detail in FIG. 2, grinding element 104 comprises a bonding edge 115 (or a bonding portion) and a grinding edge 117 (or a grinding portion). Bonding edge 115 and grinding edge 117 are located between first face 111 and second face 113, and are opposite one another. Bonding edge 115 of grinding element 104 is bonded to the outer circumferential edge 103 of carrier element 102. Grinding edge 117 is the portion of grinding element 104 configured to contact a work piece (not shown).

Figure 3:
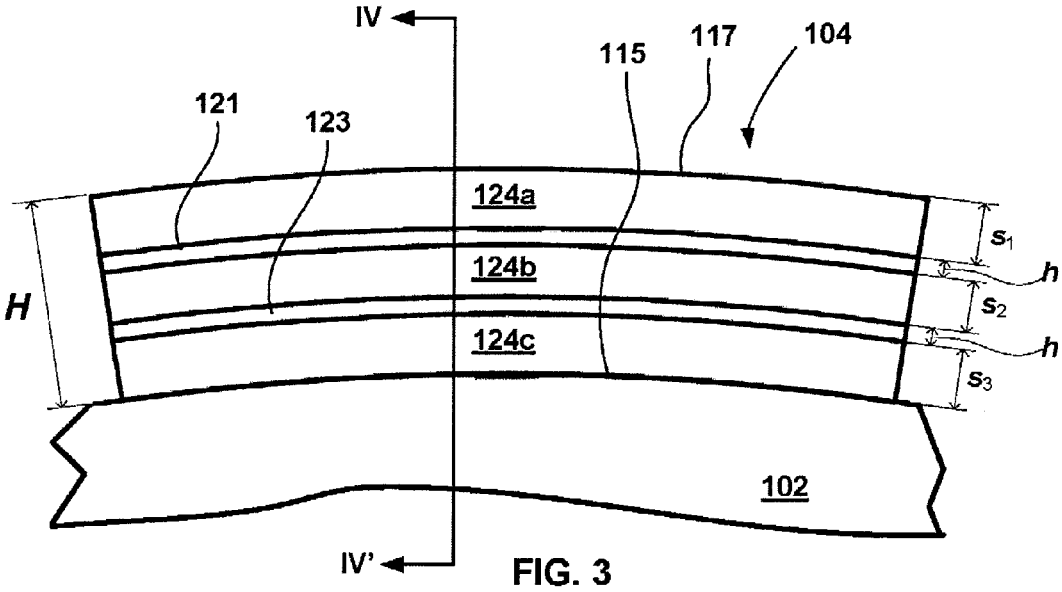
FIG. 3 illustrates a detail view of an embodiment of a tool comprising indicator marks.
Figure 5:
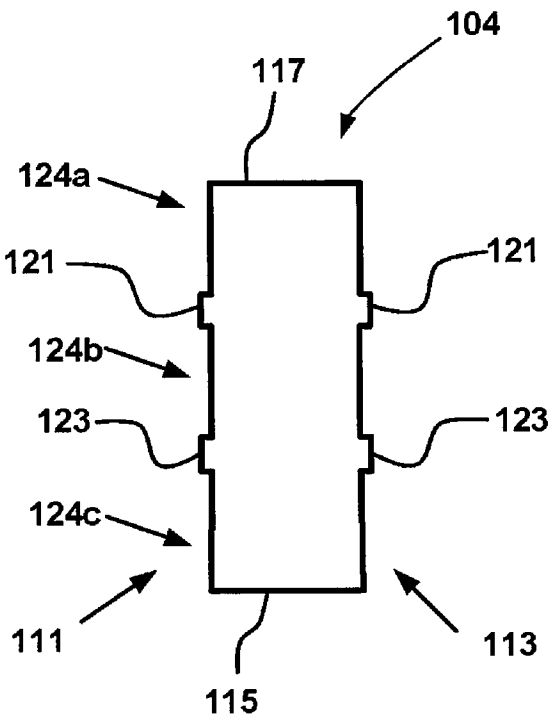
FIG. 5 illustrates a cross-section view of an embodiment of a tool comprising indicator marks.
Figure 4:
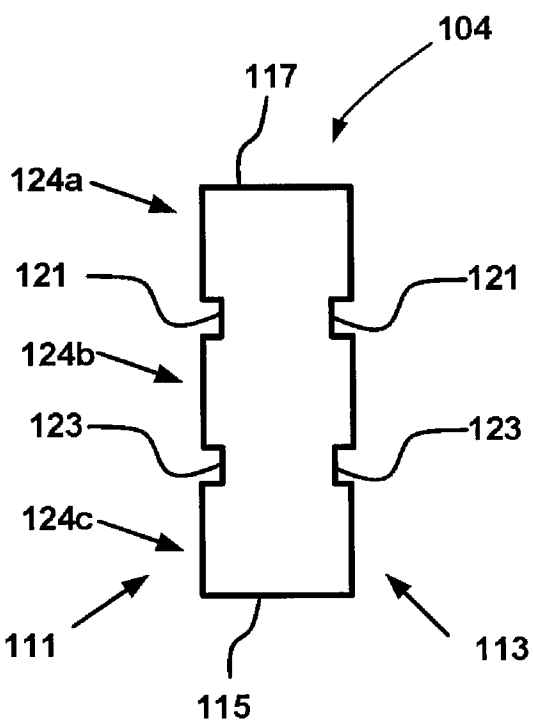
FIG. 4 illustrates a cross-section view of the tool of FIG. 3

In embodiment depicted in FIGS. 3-5, each grinding element 104 has a height H equal to the distance between bonding edge 115 and grinding edge 117. Each grinding element 104 comprises a first indicator mark 121 and a second indicator mark 123. As shown in FIG. 4, indicator marks 121, 123 are grooves in some embodiments. In other embodiments, indicator marks 121, 123 are ridges, as shown in FIG. 5.

Indicator marks 121, 123 have a mark height h in the embodiment shown. Indicator marks 121, 123 comprise arc segments that are concentric with carrier element 102. That is, indicator marks 121, 123 share a common center with carrier element 102 such that indicators 121, 123 are parallel to one another, are parallel to bonding edge 115, and are parallel to outer circumferential edge 103 of carrier element 102.

As shown in FIGS. 4 and 5, in this embodiment indicator marks 121, 123 are paired such that indicator marks 121, 123 are disposed on first face 111 and second face 113. In the illustrated embodiment, indicator marks 121, 123 are positioned such that each grinding element 104 is partitioned into three segments: first segment 124*a* having a first segment height $s_1$, second segment 124*b* having a second segment height $s_2$, and third segment 124*c* having a third segment height $s_3$.

In some embodiments, first segment height $s_1$, second segment height $s_2$, and third segment height $s_3$ are equal. In such embodiments, for each grinding element 104 having a height H and two grooves each with mark height h, each segment 124*a*, 124*b*, 124*c* has a segment height equal to (H−(2×h))/3. In other embodiments, first segment height $s_1$, second segment height $s_2$, and third segment height $s_3$ are not equal.

Other embodiments may comprise more or fewer indicator marks. For example, other embodiments may comprise one indicator mark that divides each grinding element 104 into two segments. In some embodiments, each of the two segments has an equal segment height of (H−h)/2.

Other embodiments may comprise three indicator marks that divide each grinding element 104 into four segments. In some embodiments, each of the four segments has an equal segment height of (H−(3×h))/4.

Still other embodiments may comprise N indicator marks that divide each grinding element 104 into (N+1) segments. In some embodiments, each segment has a an equal segment height of (H−(N×h))/(N+1).

In various embodiments, indicator marks 121, 123 may be either grooves or ridges. In other words, indicator marks 121, 123 are not co-planar with first face 111 or second face 113 of grinding element 104. Instead, indicator marks either extend into a face (i.e., the marks are grooves) or protrude from a face (i.e., the marks are ridges). In embodiments where indicator marks 121, 123 are grooves, indicator marks 121, 123 may be cut or etched into faces 111, 113 of grinding element 104 (e.g., as with a water cutter, a laser cutter, etc.). In other embodiments, indicator marks 121, 123 may be molded into or onto faces 111, 113 of grinding element 104.

In certain embodiments, such as those depicted in FIGS. 4 and 5, indicator marks 121, 123 run the full length of the grinding element 104. In other embodiments, indicator marks 121, 123 may run less than the full length of the grinding element.

In other embodiments, fewer than all grinding elements 104 may comprise indicator marks 121, 123. In still other embodiments, indicator marks 121, 123 are not paired, and instead may be disposed on only one face (e.g., first face 111 or second face 113) of the grinding elements 104.

In still other embodiments, indicator marks 121, 123 may alternate between faces 111, 113 of adjacent grinding elements 104. That is, each grinding element 104 having indicator marks 121, 123 on face 111 is between two grinding elements 104 having indicator marks 121, 123 on second face 113, and vice-versa.

In some embodiments, indicator marks 121, 123 may be filled with or coated with a contrasting color to enhance readability. For example, in many embodiments, grinding elements are a dull gray or brown color. Indicator marks 121, 123 may be filled with or coated with a contrasting yellow paint to allow a user to more easily observe the amount of wear on each grinding element 104. In other embodiments, first indicator mark 121 may be filled with or coated with a different color than second indicator mark 123. For example, first indicator mark 121 may be filled with or coated with a contrasting yellow paint (for example, to indicate "caution") while second indicator mark 123 may be filled with or coated with a contrasting red paint (for example, to indicate "extreme caution"). Those skilled in the art will understand that numerous contrasting colors may be used to enhance readability.

FIGS. 6A-6D depict a detail view of an embodiment of tool 10 throughout various stages of its lifecycle as the tool is ground down through use. One skilled in the art will understand that each grinding element 104 wears at approximately the same rate; thus, for ease of understanding, only a detail view of one grinding element 104 is shown.

Figure 6A:
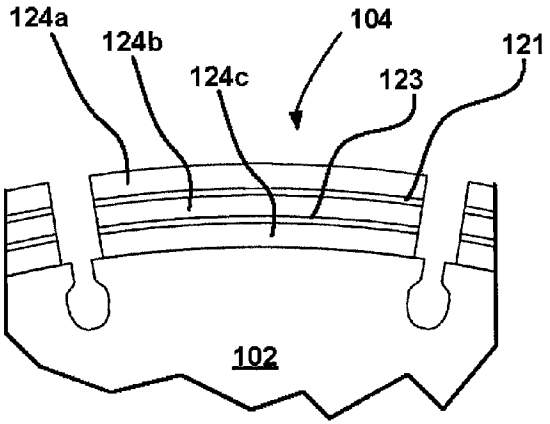
FIGS. 6A-6D illustrate a detail view of an embodiment of a grinding tool comprising indicator marks.

FIG. 6A depicts a grinding element 104 of tool 10 before the tool has been used. In this embodiment, grinding element 104 comprises first indicator mark 121 and second indicator mark 123.

Figure 6B:
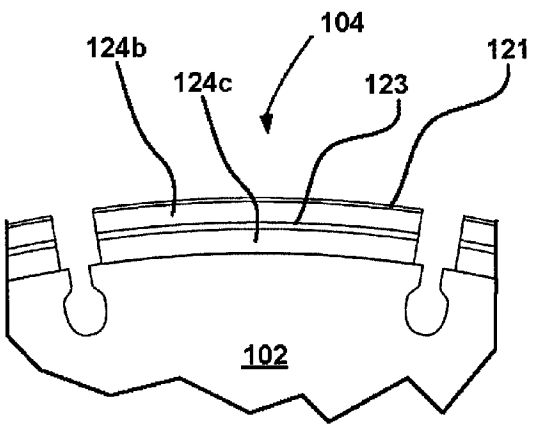

Grinding edge 117 of each grinding element 104 is worn down over time as tool 10 is used. FIG. 6B depicts tool 10 approximately one-third through its useful life, after first segment 124*a* and a portion of first indicator mark 121 of each grinding element 104 has been worn away. A user can readily ascertain that approximately one-third of each grinding element 104 has been worn away, and that approximately two-thirds of each grinding element 104 remain.

Figure 6C:
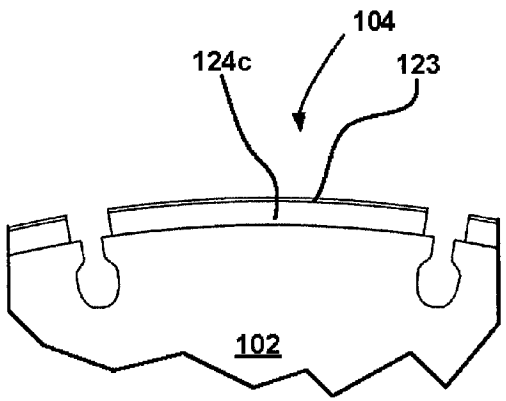

FIG. 6C depicts tool 10 approximately two-thirds through its useful life. Here, first segment 124*a*, first indicator mark 121, second segment 124*b*, and a portion of second indicator mark 123 has been worn away. A user can readily ascertain that approximately two-thirds of each grinding element 104 has been worn away, and that approximately one-third of each grinding element 104 remains. When a user observes that one-third of each grinding element 104 remains, the user may change tool 10. Or, the user will know to employ greater caution when continuing to use tool 10.

Figure 6D:
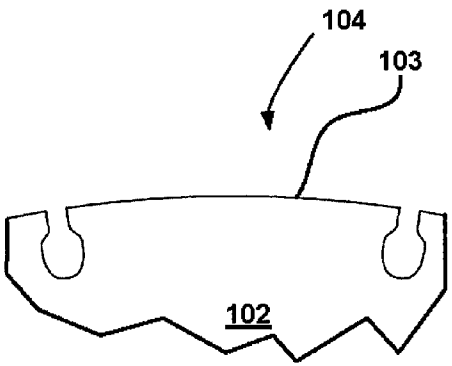

FIG. 6D depicts tool 10 at the end of its useful life after all grinding elements 104 have been ground down. Here, first segment 124*a*, first indicator mark 121, second segment 124*b*, second indicator mark 123, and third segment 124*c* have been worn away. Outer circumferential edge 103 of carrier element 102 is exposed.

Figure 7:
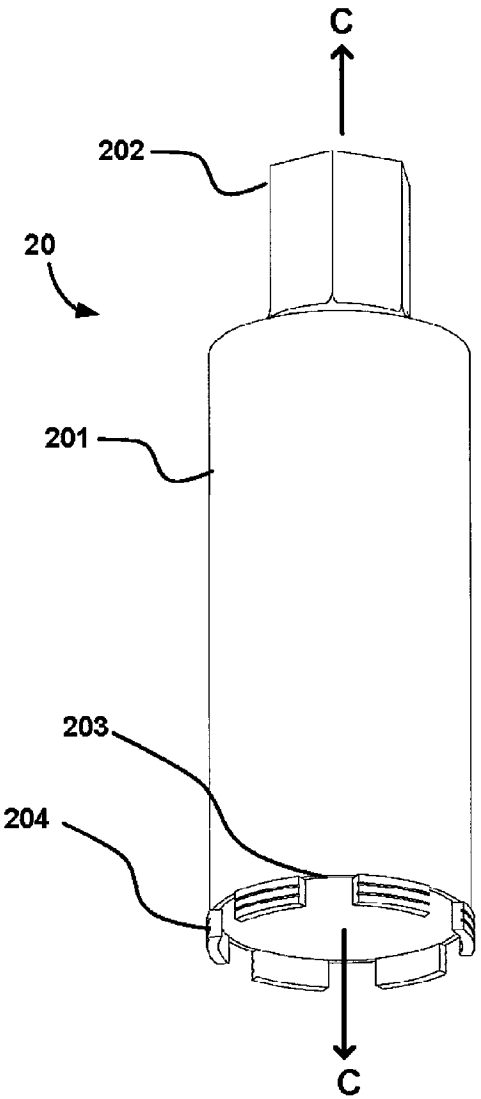
FIG. 7 illustrates an embodiment of a tool comprising indicator marks.

FIGS. 7-11D illustrate other embodiments of a tool 20, examples of which may include boring tools, drilling tools, and grinding tools. FIG. 7 illustrates an embodiment of tool 20 that is a core drill. In this embodiment, tool 20 comprises a carrier element 201 with a central axis C and a plurality of grinding elements 204 coupled to carrier element 201. In some embodiments, carrier element 201 is a hollow cylinder (e.g., a tube). A connector 202 (e.g., a threaded connector, a hexagonal bolt, a square bolt, etc.) is located at one end of tool 20. Connector 202 may be configured to be coupled to a chuck (e.g. the chuck of a drill). In some embodiments, connector 202 of tool 20 is configured to be coupled to a drill press, such as the Delta 17-959L Laser Drill Press made by Delta Machinery 4825 Highway 45 North Jackson, Tenn. 38305. In other embodiments, connector 202 of tool 20 is configured to be coupled to a handheld drill, such as the Makita BDF452HW ½" 18V Compact Lithium Ion Drill and Driver manufactured by Makita U.S.A., Inc., 14930 Northam St., La Mirada, Calif. 90638, USA.

Figure 8:
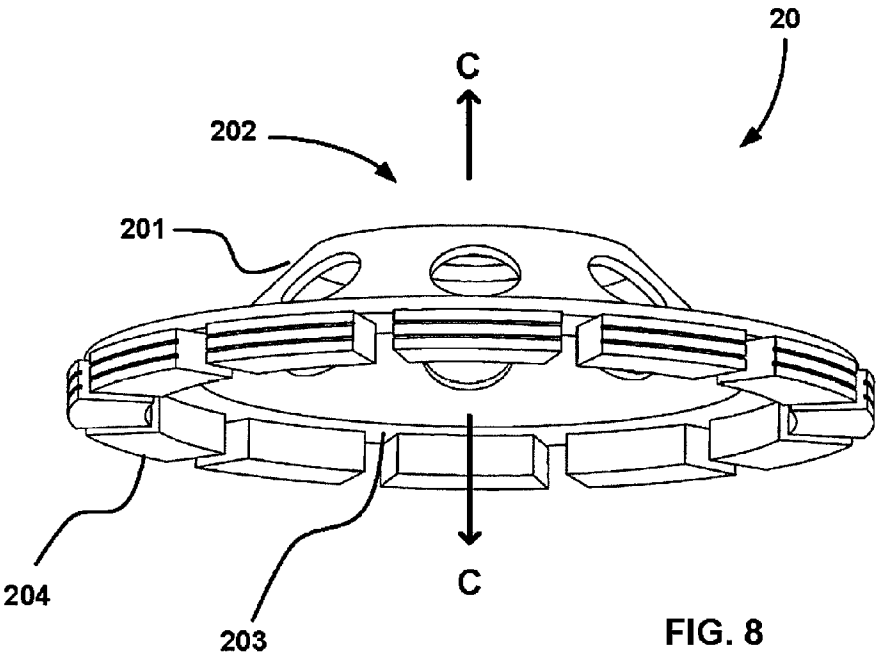
FIG. 8 illustrates an embodiment of a tool comprising indicator marks.

FIG. 8 illustrates another embodiment of tool 20, in this case, a grinding cup. In this embodiment, tool 20 comprises a carrier element 201 with a central axis C and a plurality of grinding elements 204 coupled to carrier element 201. In various embodiments, carrier element 201 may be a hollow cone, a hollow frustum, or a hollow cup. A connector 202 (e.g., a threaded connector, a hexagonal bolt, a square bolt, etc.) is located at one end of tool 20.

Figure 9:
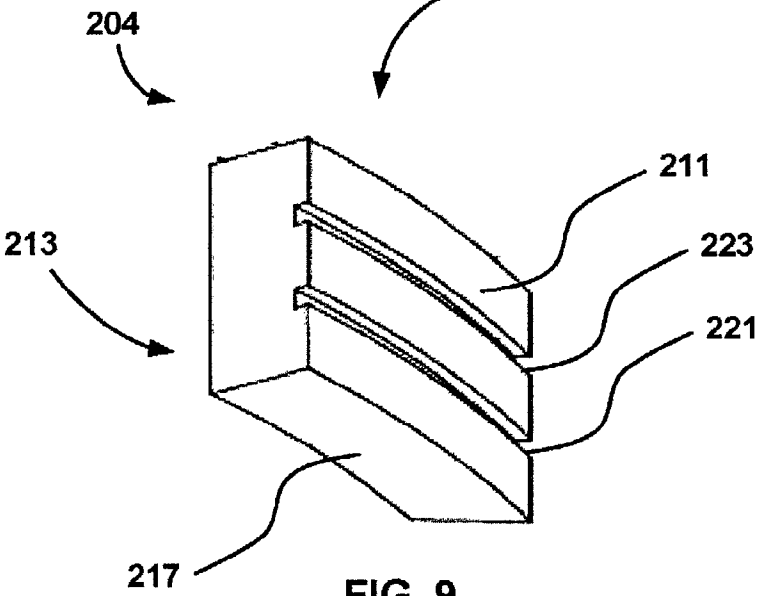
FIG. 9 illustrates a detail view of an embodiment of a tool comprising indicator marks.

As shown in detail in FIG. 9, grinding element 204 comprises a bonding edge 215 and a grinding edge 217. Bonding edge 215 (or bonding portion) and grinding edge 217 (or grinding portion) are located between outer face 211 and inner face 213, and are opposite one another. Bonding edge 215 of grinding element 204 is bonded to the outer circumferential edge 203 of carrier element 201. Grinding edge 217 is the portion of grinding element 204 configured to contact a work piece (not shown).

Tool 20 shown in the illustrated embodiments comprises a plurality of grinding elements 204. In other embodiments, however, tool 20 may comprise a single continuous grinding element 204.

Figure 10:
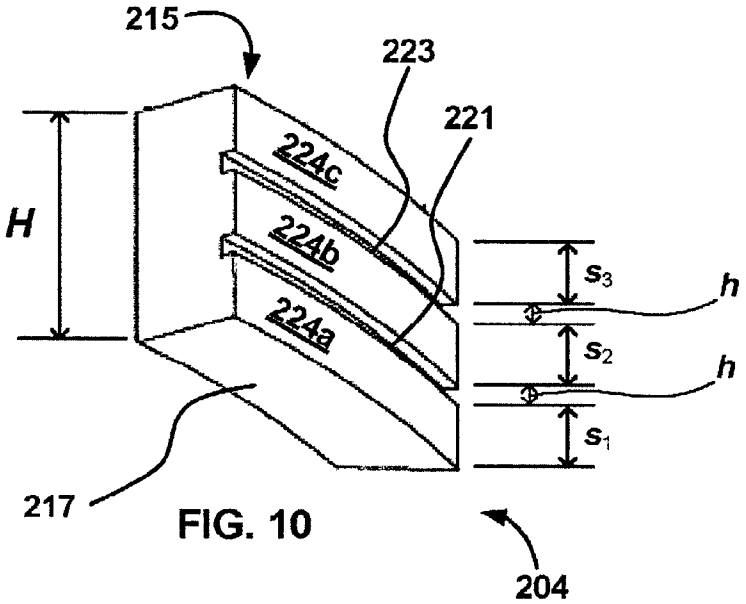
FIG. 10 illustrates a detail view of an embodiment of a tool comprising indicator marks.

In embodiment depicted in FIG. 10, each grinding element 204 has a height H equal to the distance between bonding edge 215 and grinding edge 217. Each grinding element 204 comprises a first indicator mark 221 and a second indicator mark 223. Indicator marks 221, 223 may be grooves in some embodiments and may be ridges in other embodiments.

Indicator marks 221, 223 have a mark height h in the embodiment shown. Indicator marks 221, 223 comprise arc segments that are concentric with central axis C of carrier element 201. That is, indicator marks 221, 223 are equidistant from central axis C, are parallel to one another, are parallel to bonding edge 215, and are parallel to outer circumferential edge 203 of carrier element 201.

In the illustrated embodiment, indicator marks 221, 223 are disposed on outer face 211 of each grinding element 204. In the illustrated embodiment, indicator marks 221, 223 are positioned such that each grinding element 204 is partitioned into three segments: first segment 224*a* having a first segment height $s_1$, second segment 224*b* having a second segment height $s_2$, and third segment 224*c* having a third segment height $s_3$.

In some embodiments, first segment height $s_1$, second segment height $s_2$, and third segment height $s_3$ are equal. In such embodiments, for each grinding element 204 having a height H and two grooves each with mark height h, each segment 224*a*, 224*b*, 224*c* has a segment height equal to $(H-(2\times h))/3$. In other embodiments, first segment height $s_1$, second segment height $s_2$, and third segment height $s_3$ are not equal.

Other embodiments may comprise more or fewer indicator marks. For example, other embodiments may comprise one indicator mark that divides each grinding element 204 into two segments. In some embodiments, each of the two segments has an equal segment height of $(H-h)/2$.

Other embodiments may comprise three indicator marks that divide each grinding element 204 into four segments. In some embodiments, each of the four segments has an equal segment height of $(H-(3\times h))/4$.

Still other embodiments may comprise N indicator marks that divide each grinding element 204 into (N+1) segments. In some embodiments, each segment has a an equal segment height of $(H-(N\times h))/(N+1)$.

In embodiments where indicator marks 221, 223 are grooves, indicator marks 221, 223 may be cut or etched into faces 211, 213 of grinding element 104 (e.g., as with a water cutter, a laser cutter, etc.). In other embodiments, indicator marks 221, 223 may be molded into or onto outer face 211 of grinding element 204.

In certain embodiments, such as those depicted in FIGS. 7-9, indicator marks 221, 223 run the full length of the grinding element 204. In other embodiments, indicator marks 221, 223 may run less than the full length of the grinding element.

In other embodiments, fewer than all grinding elements 204 may comprise indicator marks 221, 223. In still other embodiments, indicator grooves 221, 223 may alternate between adjacent grinding elements 204. That is, each grinding element 204 having indicator marks 221, 223 on outer face 211 is between two grinding elements 204 without indicator marks, and vice-versa.

In some embodiments, indicator marks 221, 223 may be filled with or coated with a contrasting color to enhance readability. For example, in many embodiments, grinding elements are a dull gray or brown color. Indicator marks 221, 223 may be filled with or coated with a contrasting yellow paint to allow a user to more easily observe the amount of wear on each grinding element 204. In other embodiments, first indicator mark 221 may be filled with or coated with a different color than second indicator mark 223. For example, first indicator mark 221 may be filled with or coated with a contrasting yellow paint (for example, to indicate "caution") while second indicator mark 223 may be filled with or coated with a contrasting red paint (for example, to indicate "extreme caution"). Those skilled in the art will understand that numerous contrasting colors may be used to enhance readability.

FIGS. 11A-11D depict a detail view of an embodiment of tool 20 throughout various stages of its lifecycle as the tool is ground down through use. One skilled in the art will understand that each grinding element 204 wears at approximately the same rate; thus, for ease of understanding, only a detail view of one grinding element 204 is shown.

Figure 11B:
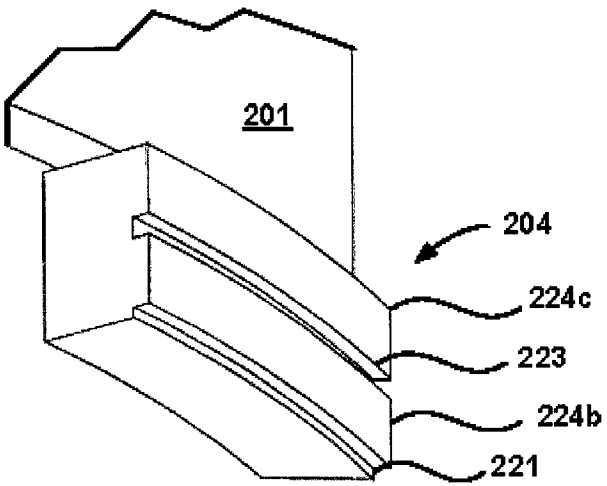
FIG. 11A-11D illustrate a detail view of an embodiment of a tool comprising indicator marks.
Figure 11A:
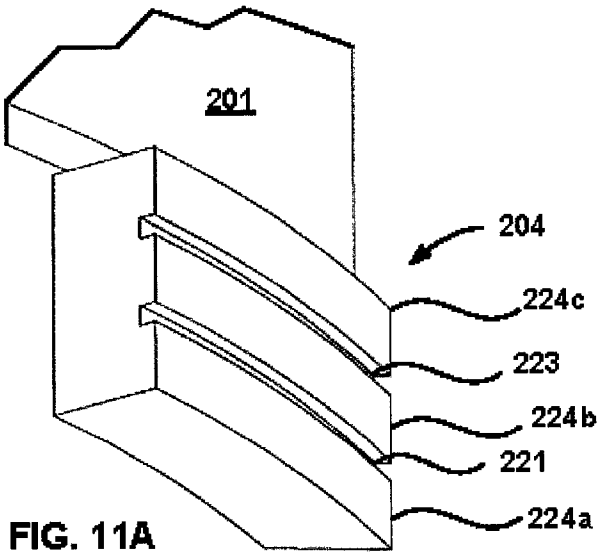

FIG. 11A depicts a grinding element 204 of tool 20 before the tool has been used. In this embodiment, grinding element 204 comprises first indicator mark 221 and second indicator mark 223.

Grinding edge 217 of each grinding element 204 is worn down over time as tool 20 is used. FIG. 11B depicts tool 20 approximately one-third through its useful life, after first segment 224*a* and a portion of first indicator mark 221 of each grinding element 204 has been worn away. A user can readily ascertain that approximately one-third of each grinding element 204 has been worn away, and that approximately two-thirds of each grinding element 204 remain.

Figure 11D:
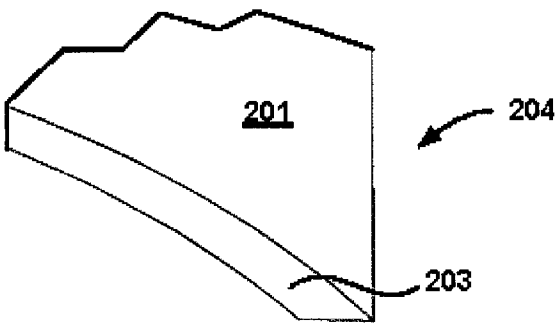
Figure 11C:
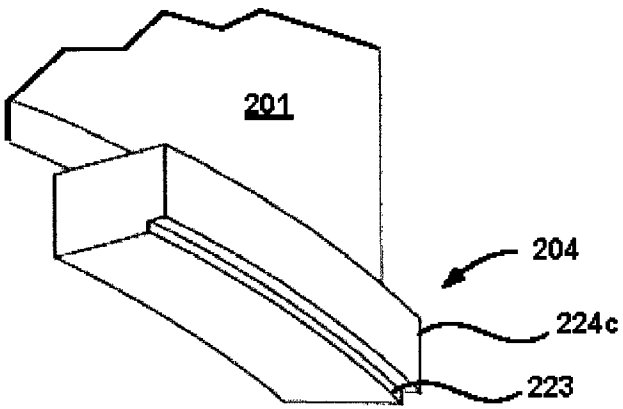

FIG. 11C depicts tool 20 approximately two-thirds through its useful life. Here, first segment 224*a*, first indicator mark 221, second segment 224*b*, and a portion of second indicator mark 223 has been worn away. A user can readily ascertain that approximately two-thirds of each grinding element 204 has been worn away, and that approximately one-third of each grinding element 204 remains. When a user observes that one-third of each grinding element 204 remains, the user may change tool 20. Or, the user will know to employ greater caution when continuing to use tool 20.

FIG. 11D depicts tool 20 at the end of its useful life after all grinding elements 204 have been ground down. Here, first segment 224*a*, first indicator mark 121, second segment 224*b*, second indicator mark 223, and third segment 224*c* have been worn away. Outer circumferential edge 203 of carrier element 202 is exposed.

Embodiments of the invention disclosed herein have the performance advantage of allowing a user to quickly and easily determine the amount of grinding element remaining. Additionally, in embodiments where the indicator marks are grooves and the carrier element is disc-shaped, the grooves will decrease the friction between the tool and the work piece.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A tool comprising a carrier element comprising an outer circumferential edge; and a grinding element comprising:

abrasive particles embedded in a metal matrix having a network of interconnected pores;

a first face;

a second face;

a grinding edge between the first face and the second face, where the grinding edge wears in use;

a bonding edge between the first face and the second face and opposite the grinding edge, where the bonding edge of each grinding element is bonded to the outer circumferential edge of the carrier element;

a height H equal to the distance between the grinding edge and the bonding edge;

a first indicator mark disposed on the first face of the grinding element; and a second indicator mark disposed on the first face of the grinding element, wherein the first and second indicator marks comprise arc segments that each have a height h, are parallel to one another and are both parallel to the outer circumferential edge of the carrier element, wherein the first and second indicator marks run the full length of the grinding element, and wherein the first and second indicator marks partition the grinding element into three segments having a height equal to $(H-(2\times h))/3$.

2. A tool comprising:

a carrier element comprising an outer circumferential edge; and a plurality of grinding elements, each grinding element comprising:

abrasive particles embedded in a metal matrix having a network of interconnected pores;

a first face;

a second face;

a grinding edge between the first face and the second face, where the grinding edge wears in use;

a bonding edge between the first face and the second face and opposite the grinding edge, where the bonding edge of each grinding element is bonded to the outer circumferential edge of the carrier element;

a height H equal to the distance between the grinding edge and the bonding edge; and N indicator marks disposed on a face of the grinding element, wherein the indicator marks comprise arc segments that are parallel to the outer circumferential edge of the carrier element;

where the N indicator marks divide each grinding element into (N+1) segments.

3. The tool of claim 2, where the indicator marks are disposed on the first face of the grinding element.

4. The tool of claim 3, where the indicator marks are disposed on the second face of the grinding element.

5. The tool of claim 2, where the indicator marks are disposed on alternating faces of adjacent grinding elements.

6. The tool of claim 2, where each segment has a segment height.

7. The tool of claim 6, where each indicator mark has a mark height h, and the segment height of each segment is equal to $(H-(N\times h))/(N+1)$.

8. The tool of claim 7, where N is 1 and each grinding element is divided into a first segment having a first segment height and a second segment having a second segment height.

9. The tool of claim 8, where the first segment height is equal to the second segment height.

10. The tool of claim 7, where N is 2 and each grinding element is divided into a first segment having a first segment height, a second segment having a second segment height, and a third segment having a third segment height.

11. The tool of claim 10, where the first segment height, the second segment height, and the third segment height are equal.

12. The tool of claim 7, where N is 3 and each grinding element is divided into a first segment having a first segment height, a second segment having a second segment height, a third segment having a third segment height, and a fourth segment having a fourth segment height.

13. The tool of claim 12, where the first segment height, the second segment height, the third segment height, and the fourth segment height are equal.

14. The tool of claim 7, further comprising N indicator marks disposed on the second face.

15. The tool of claim 7, where the indicator marks are grooves.

16. The tool of claim 7, where the indicator marks are ridges.

17. The tool of claim 2, where the carrier element is disc-shaped.

18. The tool of claim 17, where the carrier element further comprises a plurality of gullets, and where each grinding element is adjacent to two gullets.

19. The tool of claim 2, where the N indicator marks comprise a first color, the grinding elements comprise a second color, and the first color and the second color are contrasting colors.

20. A grinding element configured to be coupled to a carrier element comprising:

abrasive particles embedded in a metal matrix having a network of interconnected pores;

a first face;

a second face;

a grinding portion between the first face and the second face, where the grinding portion wears in use;

a bonding portion between the first face and the second face and opposite the grinding edge, where the bonding portion of each grinding element is configured to be bonded to the carrier element;

a height equal to the distance between the grinding portion and the bonding portion; and a first indicator mark comprising an arc segment disposed on the first face of the grinding element at a first distance from the bonding portion and parallel to the bonding portion, wherein the first indicator mark comprises a contrasting color.

* * * * *